US005601126A

United States Patent [19]

Schrepfer et al.

[11] Patent Number: 5,601,126

[45] Date of Patent: Feb. 11, 1997

[54] VESSEL FOR TRANSFERRING AND DISPENSING LIQUID

[75] Inventors: Michael W. Schrepfer, Elk Grove Village; Lee A. Schoon, Downers Grove, both of Ill.

[73] Assignee: UOP, Des Plaines, Ill.

[21] Appl. No.: 354,195

[22] Filed: Dec. 12, 1994

Related U.S. Application Data

[63] Continuation-in-part of Ser. No. 223,940, Apr. 5, 1994, abandoned.

[51] Int. Cl.[6] ..... B65B 1/04

[52] U.S. Cl. ..... 141/59; 141/286; 137/587; 251/127

[58] Field of Search ..... 141/1, 59, 286, 141/290, 307, 308, 309, 363, 364; 222/442; 137/590, 587; 251/127

[56] References Cited

U.S. PATENT DOCUMENTS

| | | | |
|---|---|---|---|
| 2,243,463 | 5/1941 | Kerr | 141/286 |
| 3,125,135 | 3/1964 | Boyer et al. | 141/290 |
| 3,139,123 | 6/1964 | Lisciani | 141/309 |
| 4,313,477 | 2/1982 | Sebalos | 141/364 |
| 4,746,034 | 5/1988 | Ata et al. | 141/364 |

*Primary Examiner*—David J. Walczak
*Assistant Examiner*—Steven O. Douglas
*Attorney, Agent, or Firm*—Thomas K. McBride; John G. Tolomei; John G. Cutts, Jr.

[57] ABSTRACT

A vessel for transferring and dispensing liquid which simultaneously recovers essentially all of the vent gas from the vessel being filled with liquid.

7 Claims, 1 Drawing Sheet

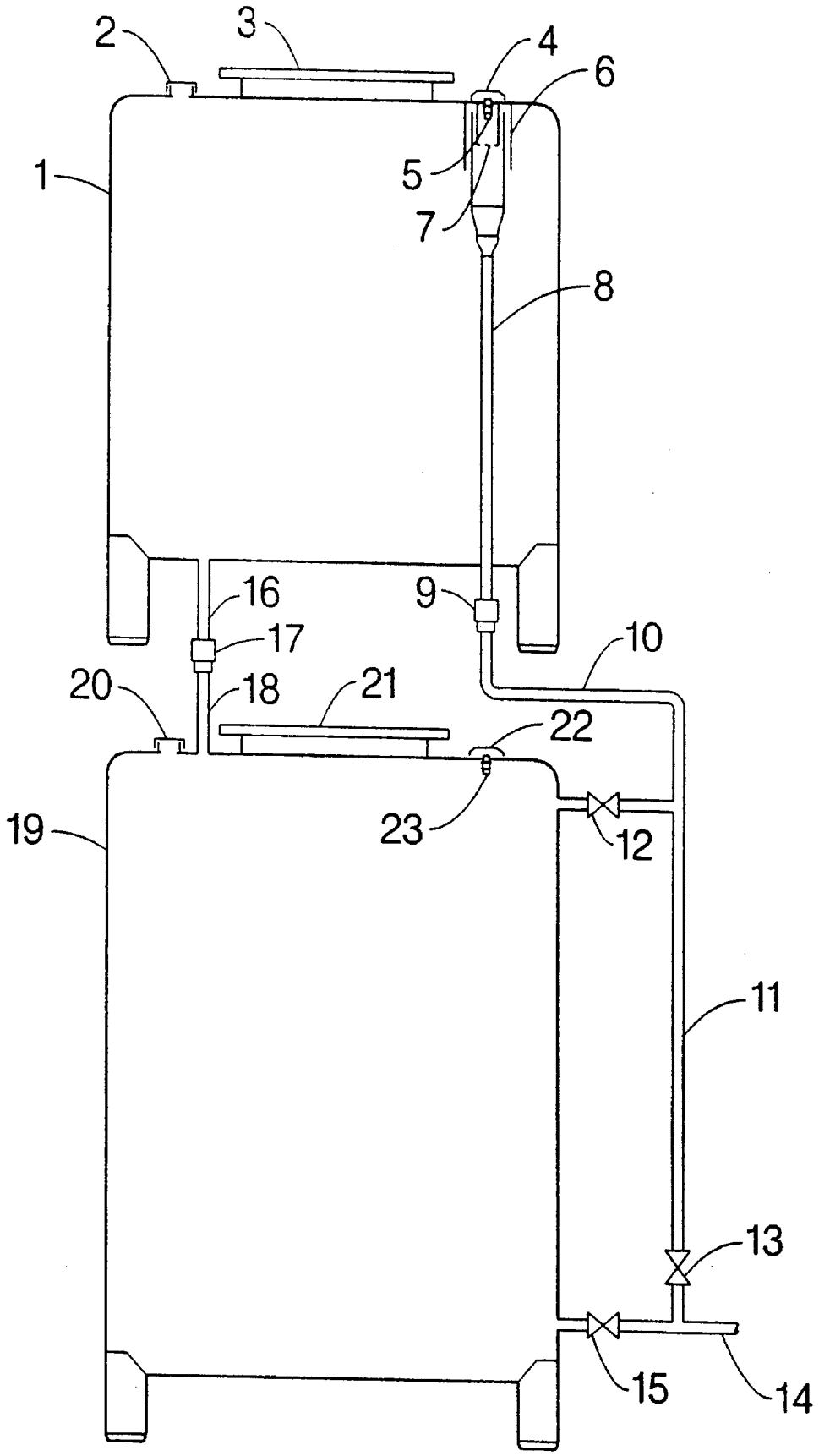
2
3
4
6
1
5
7
8
16
9
17
10
20
18
21
22
19
23
12
11
13
15
14

VESSEL FOR TRANSFERRING AND DISPENSING LIQUID

CROSS-REFERENCE TO RELATED APPLICATION

The present application is a continuation-in-part application of U.S. Ser. No. 08/223,940 filed Apr. 5, 1994, now abandoned, which is incorporated herein by reference.

FIELD OF THE INVENTION

This invention is concerned with an apparatus for transferring liquid from an upper vessel containing liquid to a lower vessel containing gas while simultaneously recovering essentially all of the gas from the lower vessel in the upper vessel.

The field of this invention is also concerned with an internal vent system and an internal baffle system.

DESCRIPTION OF RELATED ART

Many techniques in the past have addressed the problems of transferring liquids from one vessel to another or refilling a fixed storage tank from a portable tank. Undesirable situations which are encountered include difficulty in venting, overfilling, spillage, and the escape of vapors or gas contained in the empty vessel.

Normally, only a liquid outlet is provided on the top drum together with a connection into the lower or bottom drum to accept liquid transfer. At least one other system exists which is supplied with an external vent system connected via plastic tubing. This external vent system will equalize pressure between top and bottom drums, however, it is difficult to connect and frequently requires a ladder and the vent is exposed to possible damage and can become plugged by condensing vapors and/or frozen liquids during winter conditions. Furthermore, the plastic tubing which is typically used is not suitable for use with aromatic hydrocarbon-based chemicals or other aggressive plastic solvents.

When utilizing a stacked drum unit, the venting of the bottom drum to the top drum is necessary to assure rapid, safe transfer of the top drum contents, while providing an accurate level indication for the bottom drum to avoid over-filling or under-filling. Attempting to transfer liquid without a vent will result in faulty level indication in the bottom drum and typically would lead to over-filling with consequent product spillage.

In U.S. Pat. No. 3,125,135 (Boyer et al.), a filling device is disclosed wherein the device can be attached and detached without leakage of liquid or the escape of vapors from the receiving vessel.

BRIEF SUMMARY OF THE INVENTION

A method and apparatus is provided for transferring liquid from an upper vessel containing the liquid to a lower vessel containing gas while simultaneously recovering essentially all of the gas from the lower vessel in the upper vessel. The gas flows from the lower vessel through a conduit which enters the upper vessel at a lower locus and passes internally through the upper vessel to a point at least about 80% of the vertical height of the upper vessel.

BRIEF DESCRIPTION OF THE DRAWING

The drawing is a simplified sectional elevational view of an apparatus for emptying liquid from an upper vessel containing liquid to a lower vessel containing gas while simultaneously recovering essentially all of the gas from the lower vessel in the upper vessel.

DETAILED DESCRIPTION OF THE INVENTION

The present invention is particularly suitable for the easy transfer of liquid when utilizing stackable returnable semi-bulk containers. The present invention provides a safe and accessible liquid-free connection for the transfer of liquid from an upper vessel. The upper vessel incorporates an internal vent which eliminates exposed lines, the separate installation of external piping and connections which assures the safe and rapid transfer of liquid while providing pressure equalization between the upper and the lower vessel. Advantages of the present invention include a grade level single point connection and an internal vent line. The internal vent line avoids exposed vent lines, possible freezing of condensed vapors and extra connections made to the upper vessel prior to transfer or stacking.

One embodiment of the present invention provides a safe, easily accessible and dry connection of the upper vessel in a two-vessel stacked unit. A lower vessel is used to hold a working inventory of a liquid to be removed and utilized. As the contents of the lower vessel are depleted, additional liquid is delivered via an upper vessel which may be conveniently placed on top of the lower vessel. Simultaneously, the gas from the lower vessel is transferred to the upper vessel without the release of any gas to the atmosphere. When utilizing the apparatus of the present invention, proper venting of the lower drum to the upper vessel is achieved to assure rapid, safe transfer of the liquid from the top drum while providing an accurate level indication for the lower vessel to avoid over filling. The vent of the present invention provides an accurate level indication in the lower vessel which aids in avoiding overfilling and spillage.

In accordance with the present invention, the vent line for the upper vessel is self-contained and internal. The internal vent incorporates a unique inlet baffling system which protects the vent line from collecting liquid during the transport and movement of the vessel prior to emptying. The internal vent line is protected from freezing in the unlikely event of liquid entering the vent line and avoids the need for removal and reattachment of an external vent system when installing a full upper vessel or removing an empty upper vessel.

In a preferred embodiment of the present invention, the conduits which connect the upper and lower vessels incorporate quick-connect couplings which allows handling of liquid without danger of spillage and provides a simple and dry connection. The internal vent system used in conjunction with quick-connect couplings not only eliminates liquid spills, but also contains the gas which is displaced from the lower vessel during the filling with liquid. The internal baffle in cooperation with the internal vent line defines an advantageous location for installing a vacuum breaker valve. The vacuum breaker valve prevents damage to the vessel if a negative pressure developed inside the vessel. This location protects the vacuum breaker from contact with the liquid contents, thereby eliminating the possibility of misoperation of the vacuum breaker valve or possible leakage of liquid from the vessel.

In one aspect and embodiment of this invention, a lower vessel is used to store and supply liquid, and as the inventory diminishes, a second vessel containing a new supply of liquid is positioned at a higher elevation than the first vessel and may conveniently be rested upon the first vessel. A conduit is then connected from a lower locus of the upper vessel to the lower vessel to permit the flow of liquid to the lower vessel. Another conduit is connected from an upper locus of the lower vessel to the internal vent of the upper vessel. The external connection for the internal vent is at a lower locus of the upper vessel. Two baffles attached to an upper surface of the upper vessel and located at the terminal end of the internal vent permit the flow of gas, but restrict the flow of liquid from the vessel into the internal vent. The baffles also protect the vacuum breaker valve from contact with the liquid during the transportation of a full upper vessel. After the connections have been made and the valves are opened, the liquid begins to flow by gravity from the upper vessel to the lower vessel. Simultaneously, the gas which is displaced by the liquid flowing into the lower vessel flows through the internal vent of the upper vessel to recover the gas and to equalize the pressure in each vessel. The upper vessel is usually equal to or smaller in volume than the lower vessel so that the upper vessel may be loaded into the lower vessel in one operation and then the upper vessel may be removed in preparation for the installation of a new, full upper vessel.

DETAILED DESCRIPTION OF THE DRAWING

Referring now to the drawing, there is shown an upper vessel 1 having a pressure relief valve 2, and a flanged manway 3. Pressure relief valve 2 serves to prevent the over-pressuring of upper vessel 1 due to a variety of potential causes and thereby preventing structural damage to upper vessel 1. Flanged manway 3 is used for cleaning, inspecting and filling upper vessel 1 as needed. Liquid outlet conduit 16 is attached to a lower locus of upper vessel 1 and is in communication to provide the exit of liquid from the interior of upper vessel 1. Gas inlet conduit 8 enters at a lower locus of upper vessel 1 and is used to transport gas in an upward manner to an upper locus of upper vessel 1. A vacuum breaker valve 5 is located on an upper horizontal surface of upper vessel 1 and is used to prevent a vacuum from forming in the interior of upper vessel 1 which may be detrimental to the structural integrity. Weather cover 4 is attached to upper vessel 1 immediately above vacuum breaker valve 5 in order to provide physical protection as well as protection from the elements of the ambient atmosphere. An outer baffle 6 is cylindrical in shape and is attached to an upper inner surface of upper vessel 1 in a location which is generally coaxial with vacuum breaker valve 5. An inner baffle 7 is attached to an upper inner surface of upper vessel 1 at a location which is also coaxial with vacuum breaker valve 5 and has a diameter which is less than that of outer baffle 6. An upper end of gas inlet conduit 8 is positioned in the annulus which is formed by outer baffle 6 and inner baffle 7. The arrangement of outer baffle 6, inner baffle 7 and the terminal end of gas inlet conduit 8 provides for a serpentine flow of the gas through gas inlet conduit 8 and around outer baffle 6. In the event gas passes through vacuum breaker valve 5, the gas also passes in a serpentine fashion around inner baffle 7, the terminal end of gas inlet conduit 8 and outer baffle 6. The length of outer baffle 6 and inner baffle 7 is selected to prevent liquid from entering gas inlet conduit 8 during the normal handling of upper vessel 1 during filling, shipping, installing and emptying.

Lower vessel 19 is located in a generally lower position than upper vessel 1 and has a pressure relief valve 20 and a flanged manway 21. Flanged manway 21 is used to gain access to the interior for cleaning, maintenance and inspection. Lower vessel 19 has a liquid inlet conduit 18 located in an upper locus which is used to supply liquid to lower vessel 19 via liquid outlet conduit 16 from upper vessel 1 and quick disconnect coupling 17. A weather cover 22 is provided on lower vessel 19 in order to afford protection to vacuum breaker valve 23. Gas is removed from lower vessel 19 via gas conduit and valve 12, gas conduit 10 and quick disconnect coupling 9 into gas inlet conduit 8 which is associated with upper vessel 1 as described hereinabove. Lower vessel 19 has a sight glass 11 which is in communication with lower vessel 19 via valve 12, valve 15, and valve 13. A liquid supply conduit 14 is utilized to withdraw liquid from lower vessel 19 as required.

The foregoing description and drawing clearly illustrate the advantages encompassed by the present invention and the benefits to be afforded with the use thereof.

What is claimed:

1. A vessel for transferring and dispensing liquid which vessel comprises:

(a) a liquid outlet located in a lower locus of said vessel;

(b) a gas inlet located in a lower locus of said vessel;

(c) a conduit which is in communication with said gas inlet and extends in a generally upward direction to an upper locus of said vessel and defines a terminal end in an upper locus of said conduit;

(d) a first cylindrical baffle connected to and extending downwardly from an upper surface of said vessel and coaxially surrounding the terminal end of said conduit to define a first annular space for the passage of gas;

(e) a second cylindrical baffle connected to and extending downwardly from an upper surface of said vessel and coaxially into the terminal end of said conduit to define a second annular space for the passage of gas; and (f) a vacuum relief valve located on the upper surface of said vessel so as to be disposed within said second cylindrical baffle.

2. The vessel of claim 1 wherein said conduit is essentially vertical.

3. The vessel of claim 1 wherein said conduit extends upwardly through at least about 80% of the vertical height of said vessel.

4. The vessel of claim 1 wherein said first cylindrical baffle extends essentially vertically downward from said upper surface of said vessel.

5. The vessel of claim 1 wherein said upper surface of said vessel is essentially horizontal.

6. The vessel of claim 1 wherein said second cylindrical baffle extends essentially vertically downward from said upper surface of said vessel.

7. A method for transferring liquid from an upper vessel containing said liquid to a lower vessel containing gas while simultaneously recovering essentially all of said gas from said lower vessel in said upper vessel wherein said method comprises:

(a) flowing said liquid from a lower locus of said upper vessel via a first conduit in communication with said upper vessel and said lower vessel into said lower vessel;

(b) flowing said gas from an upper locus of said lower vessel via a second conduit which enters a lower locus of said upper vessel and transports said gas upwardly through at least about 80% of the vertical height of said upper vessel; and, (c) flowing said gas from an upper terminal end of said second conduit and through a circuitous path defined by said upper terminal end of said second conduit in cooperation with a cylindrical baffle connected to and extending downwardly from an upper surface of said upper vessel and coaxially surrounding the terminal end of said second conduit to define an annular space.

* * * * *